US007000421B2

(12) United States Patent
Lee et al.

(10) Patent No.: US 7,000,421 B2
(45) Date of Patent: Feb. 21, 2006

(54) PIPING STRUCTURE OF AIR CONDITIONER

(75) Inventors: Jung Woo Lee, Seoul (KR); Sim Won Chin, Gwangmyeong-si (KR); In Hwa Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 40 days.

(21) Appl. No.: 10/750,873

(22) Filed: Jan. 5, 2004

(65) Prior Publication Data

US 2005/0081550 A1 Apr. 21, 2005

(30) Foreign Application Priority Data

Oct. 15, 2003 (KR) ..... 10-2003-0071783

(51) Int. Cl.
*F25D 19/00* (2006.01)

(52) U.S. Cl. ..... 62/296; 62/298; 248/638

(58) Field of Classification Search ..... 62/295, 62/296, 298; 248/49, 638, 645
See application file for complete search history.

(56) References Cited

U.S. PATENT DOCUMENTS

| | | | | |
|---|---|---|---|---|
| 3,918,850 | A * | 11/1975 | Bridigum | 417/363 |
| 4,614,091 | A * | 9/1986 | Frank et al. | 62/384 |
| 6,442,959 | B1 * | 9/2002 | Sone | 62/333 |
| 2004/0031283 | A1 * | 2/2004 | Ahn et al. | 62/295 |

* cited by examiner

*Primary Examiner*—Marc Norman
(74) *Attorney, Agent, or Firm*—Birch, Stewart, Kolasch & Birch, LLP

(57) ABSTRACT

An improved piping structure of an air conditioner can minimize a vibration by change in a piping shape in looped pipings. In the piping structure, a first directional piping part configured on a same plane is changed to be slanted at a predetermined angle on one end thereof, to be displaced onto a third plane, and to be connected with a second directional piping part configured on a different plane from that of the first directional piping part. Further, the piping structure comprises a vertical piping part wound in an up and down direction and a horizontal piping part connected to the vertical piping part having one end changed at a predetermined slant angle.

8 Claims, 8 Drawing Sheets

PIPING STRUCTURE OF AIR CONDITIONER

This Nonprovisional application claims priority under 35 U.S.C. § 119(a) on patent application Ser. No(s). 10-2003-0071783 filed in KOREA on Oct. 15, 2003, the entire contents of which are hereby incorporated by reference.

BACKGROUND OF THE INVENTION

1. Field of the Invention

The present invention relates to an improved piping structure of an air conditioner, designed to minimize a vibration by changing a piping shape in looped pipings of the air conditioner.

2. Background of the Related Art

Hereinafter, description will be made about the prior art.

In general, a compressor refers to a machine used to compress a gaseous medium in various fields. The compressor used in the air conditioner where compression, condensation, expansion and evaporation are sequentially generated is used for compression.

FIG. 1 is a schematic view showing a conventional air conditioner.

Referring to FIG. 1, the conventional air conditioner includes an outdoor unit 10 disposed outdoors to make a heat exchange, an indoor unit 20 disposed indoors to condition indoor air, and a connection piping 30 for connecting the outdoor unit and the indoor unit.

To be more specific, the outdoor unit 10 is a means for transforming a gaseous refrigerant of low temperature and pressure, which is introduced from the indoor unit 20, into a liquid refrigerant while a heat exchange with outdoor air takes place. The outdoor unit 10 is composed of a compressor 11, a condenser 12 and an expansion valve 13.

Further, the compressor 11 is a member where the gaseous refrigerant of low temperature and pressure which is introduced from the indoor unit 20 is transformed into a gaseous refrigerant of high temperature and pressure. The condenser 12 is a member where the gaseous refrigerant of high temperature and pressure is transformed into a liquid refrigerant of intermediate temperature and high pressure. The expansion valve 13 is a member where the liquid refrigerant of intermediate temperature and high pressure is transformed into a liquid refrigerant of low temperature and pressure.

Here, the condenser 12 is a member where a heat exchange with the outdoor air is directly made, and is provided with a separate fan 12*a* in order to take in the outdoor air. Meanwhile, the indoor unit 20, in which the liquid refrigerant of low temperature and pressure introduced from the outdoor unit 10 is evaporated and transformed into the gaseous refrigerant of low temperature and pressure, causes the indoor temperature to be lowered with the use of the evaporation at this time.

The indoor unit 20 includes an evaporator 21 where the liquid refrigerant of low temperature and pressure is transformed into the gaseous refrigerant of low temperature and pressure, and a fan 21*a*. The connection piping 30 is a member for connecting the outdoor unit 10 and the indoor unit 20 so as to force the refrigerant to be circulated, and is appropriately disposed according to a distance between the outdoor unit 10 and the indoor unit 20.

By the way, there occurs a lot of vibration from the compressor 11 located at the outdoor unit 10 during compression. Such vibration is transmitted to other members via intake and discharge pipings connected to the compressor 11.

The transmission of the vibration generated from the compressor 11 results in vibrating the whole air conditioner. This causes a serious problem in that an excessive noise is generated not only to give annoyance to a user but also to accumulate the vibration for a long time to incur a component breakdown caused by fatigue. Thus, there is required an approach for solving this problem, so that it is proposed in the prior art that the intake or discharge piping is subjected to looping at a predetermined location, that a length of the piping is extended, that at least one lumped mass element is attached/applied to the piping, or so forth.

For a piping structure around the conventional compressor with reference to FIG. 2, pipings 152 and 153 connected to the compressor are looped, and then are added by a lumped mass element 140.

Here, the conventional air conditioner having the piping structure as mentioned above is designed so that the gaseous refrigerant of low temperature and pressure introduced from the indoor unit (not shown) enters the outdoor unit through an external piping connected to a service valve 110, and then the gaseous refrigerant of low temperature and pressure introduced in this manner is subjected to removal of its liquid component by means of an accumulator 130, compression at the compressor 150, and change into the gaseous refrigerant of high temperature and pressure, and enters the condenser.

Meanwhile, while the compressor 150 performs a compression process, there is generated serious vibration according to operation of the compressor 150. This vibration is transmitted to other components of the air conditioner via intake and discharge pipings 152 and 153 connected to the compressor 150, thus having bad influence. For this reason, it is necessary to regulate such vibration.

When constraint of transmission of this vibration is intended to increase lengths of the pipings, the constraint is solved either by performing looping to secure the lengths, or by mounting the lumped mass element 140 made of an elastic material such as a rubber at a predetermined position of the looped pipings. In general, the lumped mass element 140 is located at a lower end position of the looped intake and discharge pipings 152 and 153 of the compressor 150.

Further, all the pipings connected to both the compressor 150 and the accumulator 130 pass through a reversing coil 120, and thereby the vibration is suppressed.

Here, the reversing coil 120 is preferably disposed in a rear upper space of the system so as not to interfere the intake and discharge pipings. Inlet and outlet of the reversing coil 120 are oriented downward.

Here, the looping of the intake piping 152 is constructed to linearly face upward by beginning with the accumulator 130 to be bent in a reverse U shape and then in an L shape at the reversing coil 120 in an upward direction.

Meanwhile, the looping of the discharge piping 153 is constructed to linearly face upward by beginning with a discharging part to be bent in a reverse U shape and then in an U shape along a base side again, and finally in an L shape at the reversing coil 120.

Further, a gaseous refrigerant tube 151 for transporting the gaseous refrigerant introduced into the compressor 150 is directly connected to the reversing coil 120 on one end without any looping, and is connected to the service valve 110 on the other end in order to facilitate connection with the external piping.

FIG. 3 is a schematic view showing a conventional looped piping structure.

As shown in the drawing, the looping of the piping 153 of the compressor 150 is preformed by reverse U shaped bending, looping up and down several times, and looping in a horizontal direction.

However, in the conventional piping structure as mentioned above, the whole pipings have a weak strength in an up and down (Z-axial) direction. Thus, the vibration generated from the compressor fails to be efficiently reduced in the piping of the air conditioner. Consequently, this causes the air conditioner to be vibrated as a whole, which leads to serious problems in that excessive noises are generated to give the user an unpleasant feeling, that the vibration is accumulated for a long time, thus incurring breakdown of components caused by a fatigue and so forth.

SUMMARY OF THE INVENTION

An object of the invention is to solve at least the above problems and/or disadvantages and to provide at least the advantages described hereinafter.

Accordingly, one object of the present invention is to solve the foregoing problems by providing a piping structure of an air conditioner in which by changing a piping shape and avoiding forming a looping part on the same plane, a piping strength is increased in an up and down (Z-axial) direction in the whole pipings and an excessive vibration is remarkably reduced in the piping of the air conditioner.

The foregoing and other objects and advantages are realized by providing a piping structure of an air conditioner, in which pipings are looped, characterized in that a first directional piping part configured on a same plane is changed to be slanted at a predetermined angle on one end thereof, to be displaced onto a third plane, and to be connected with a second directional piping part configured on a different plane from that of the first directional piping part.

According to another aspect of the invention, a piping structure of an air conditioner comprises a vertical piping part wound in an up and down direction, and a horizontal piping part connected to the vertical piping part having one end changed at a predetermined slant angle.

The piping structure further comprises a vibration damping part slantly connected to the vertical piping part as a first directional piping part and to the horizontal piping part as a second directional piping part.

According to another aspect of the invention, the vertical piping part takes a form wound at least one times in an up and down direction, and has a looping part by slantly connecting one end of a vibration damping piping part at an arbitrary position of vertical piping part and by horizontally connecting the other end of the vibration damping piping part.

According to another aspect of the invention, the vibration damping piping part has a slant angle ranging from about 20 to 60 degrees.

According to another aspect of the invention, the slant angle of the vibration damping piping part causes a vertical vibration to be divided according to a force vector decomposition.

According to another aspect of the invention, the vibration damping piping part has a difference more than 50 mm between highest and lowest heights.

Thus, according to the invention, the piping strength is increased in the up and down direction in the whole pipings, so that the vibration is remarkably reduced in the piping of the air conditioner. Consequently, the vibration of the air condition is suppressed as a whole, so that excessive noises are no longer generated not only to prevent the unpleasant feeling from being given to the user but also to prevent breakdown of components caused by a fatigue resulting from accumulation of the vibration for a long time in advance.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a piping structure of an air conditioner according to a preferred embodiment of the invention with reference to the accompanying drawings.

First, a general description will be made on the invention.

The invention relates to a piping structure, in which by forming a looping part on another plane to weaken a vibration in an up and down (Z-axial) direction in the whole pipings, a piping strength is increased to remarkably reduce the vibration in the whole pipings of an air conditioner, thereby suppressing the vibration of the air conditioner as a whole, preventing generation of excessive noises, preventing an unpleasant feeling from being given to a user, and preventing breakdown of components caused by a fatigue resulting from accumulation of the vibration for a long time.

Figure 1:
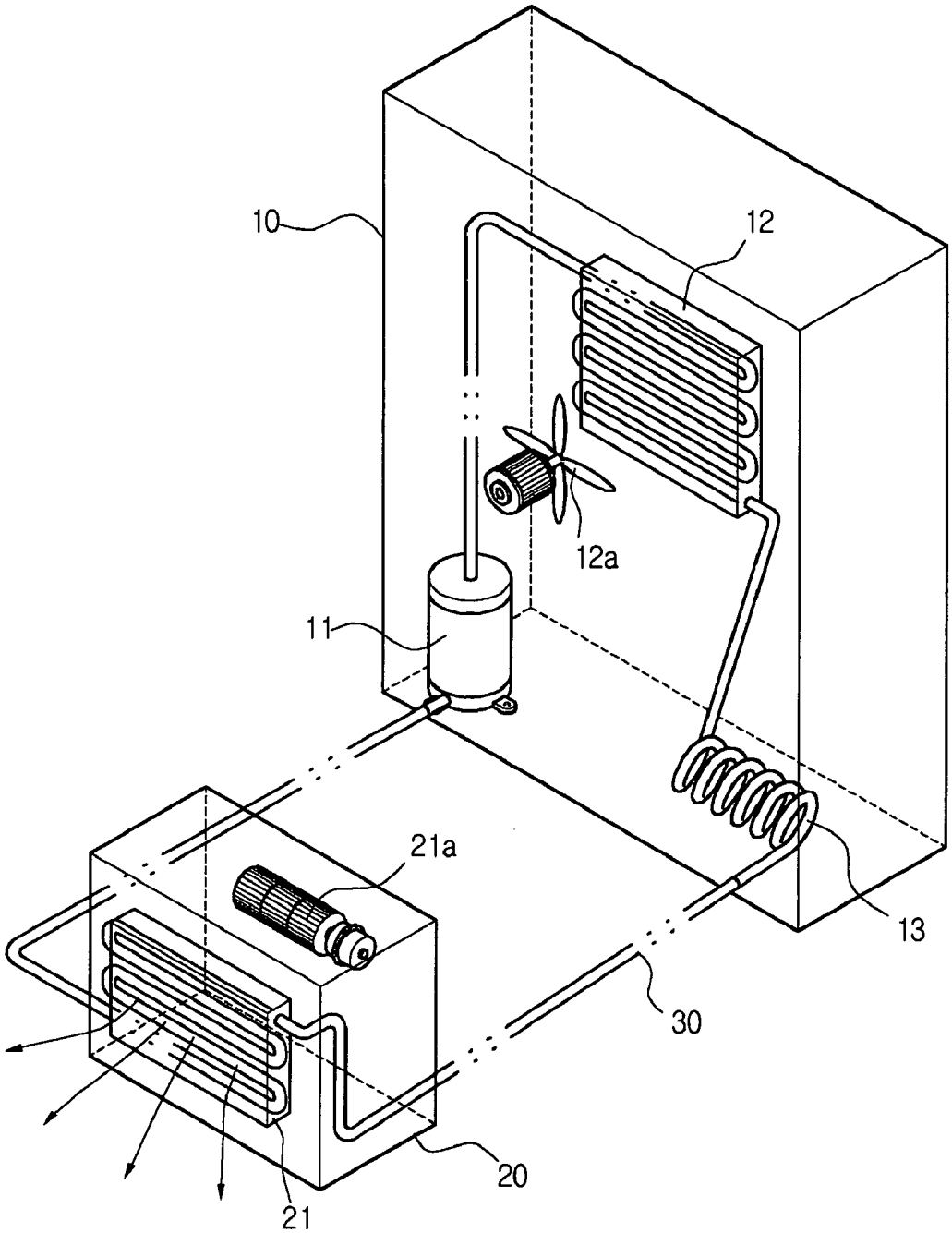
Fig.1 Related Art
FIG. 1 is a schematic view showing a conventional air conditioner.
Figure 2:
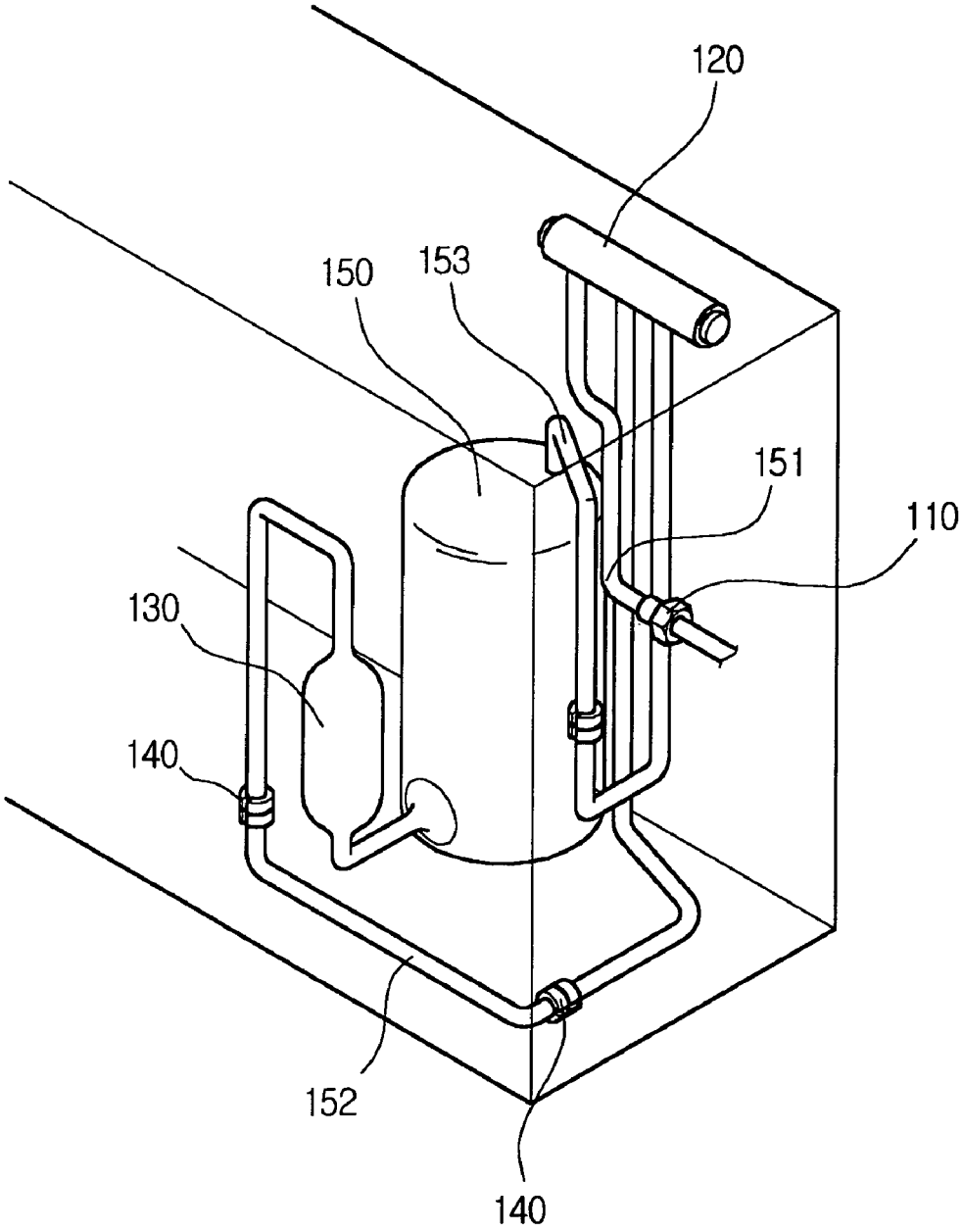
Fig.2 Related Art
FIG. 2 is a schematic view showing a piping structure around a compressor according to the prior art.
Figure 3:
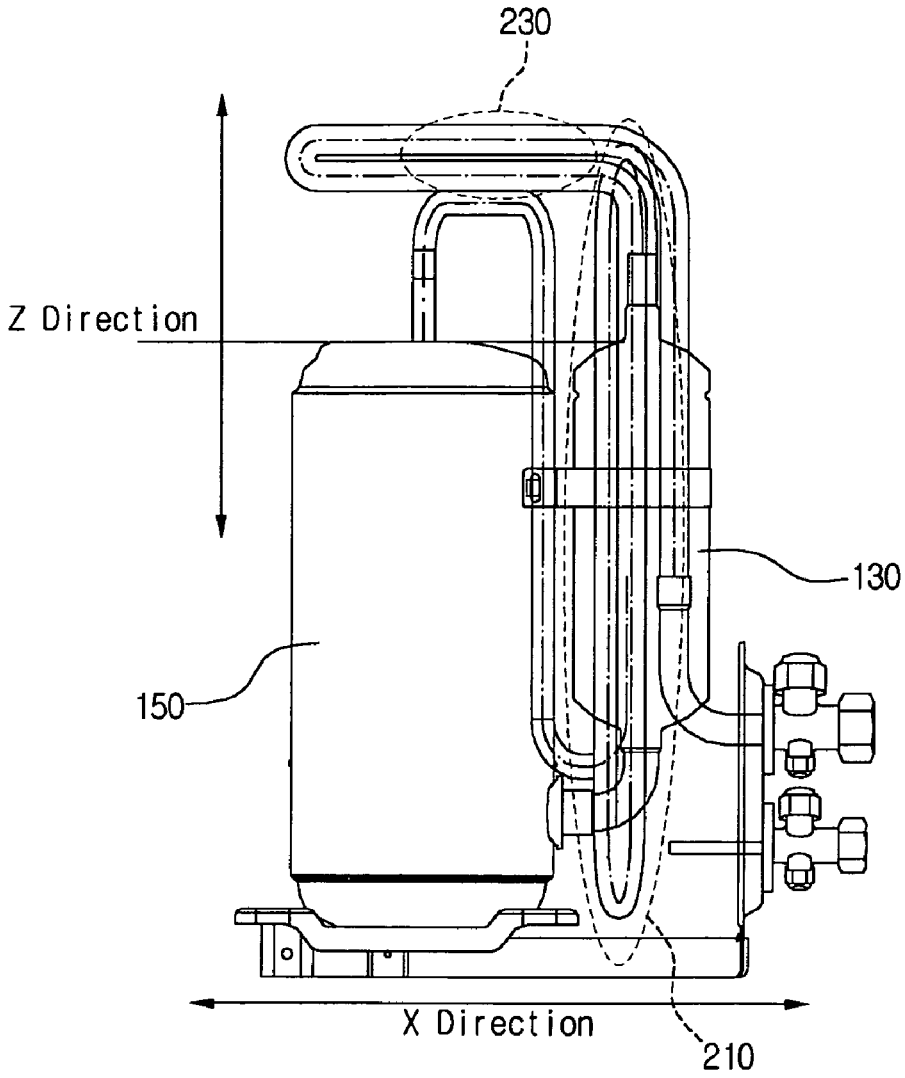
Fig.3 Related Art
FIG. 3 is a schematic view showing a conventional looped piping structure.
Figure 4A:
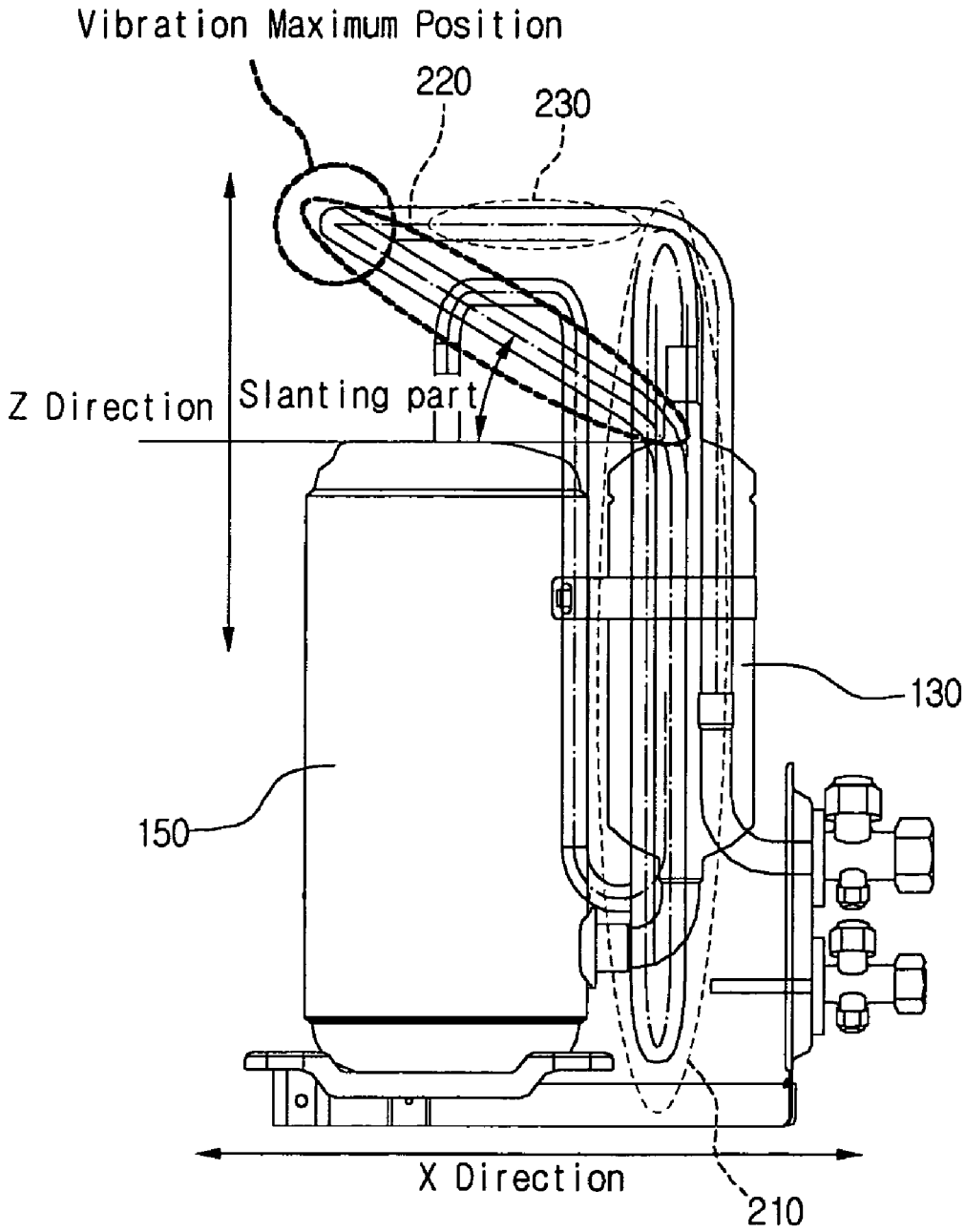
FIG. 4*a* is a schematic view showing a piping structure around a compressor in accordance with the invention.
Figure 4B:
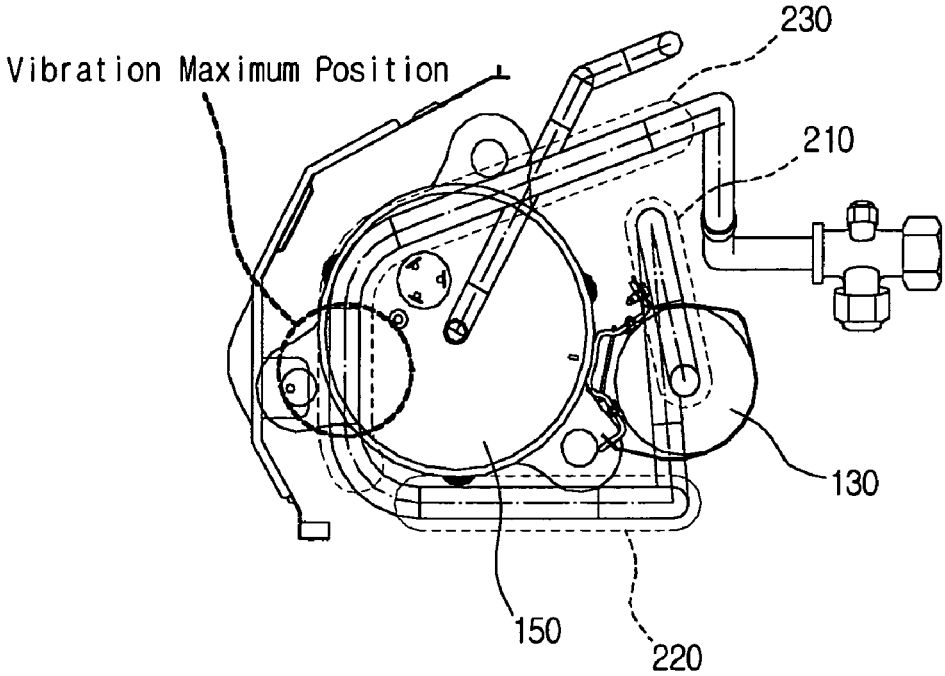
FIG. 4*b* is a top view of FIG. 4*a;*

FIG. 4*a* is a schematic view showing a piping structure around a compressor in accordance with the invention, and FIG. 4*b* is a top view of FIG. 4*a*.

Referring to FIGS. 4*a* and 4*b*, the piping structure according to the invention is characteristic of a vertical piping part wound in an up and down direction, and a looping part, as a piping, connected to one end of the vertical piping part in a horizontal direction, and particularly further includes a vibration damping part slantly connected between the vertical piping part and the looping part.

To be seen in detail, a piping extending from an accumulator 130 takes a form wound several times in roughly annular shape in the up and down direction, thus consisting of the vertical piping part 210, at an arbitrary position of which one end of a vibration damping piping part 220 is slantly connected. The looping part 230 is horizontally connected on the other end of the vibration damping piping part 220. Thereby, the whole pipings are formed.

In the air conditioner having the above-mentioned piping structure according to the invention, a compressor 150 of an outdoor unit is operated to convert a gaseous refrigerant of low temperature and pressure, which is introduced from an indoor unit in order to perform heat exchange with external air, into a gaseous refrigerant of high temperature and pressure. At this time, a vibration generated according to operation of the compressor 150 is efficiently dispersed. As a result, owing to the process of efficiently dispersing the vibration, the vertical piping strength is increased in the whole pipings. Thus, in the piping of the air conditioner, the vibration is remarkably reduced.

To be seen in more detail, in the above-mentioned piping structure according to the invention, the vibration generated according to operation of the compressor 150 includes a first directional component as a Z-axial (up and down) component and a second directional component as an X-axial (left and right) component. Here, when the vibration of the Z-axial component is applied to the piping structure, the Z-axial vibration component is dispersed by the vibration damping piping part 220. This is because the Z-axial vibration component is divided by the vibration damping piping part 220 which is slantly connected between the vertical piping part 210 and the looping part 230. Specifically, the Z-axial vibration component is divided into a horizontal one parallel to the vibration damping piping part 220 and a vertical one perpendicular to the vibration damping piping part 220.

Here, the original Z-axial vibration component divided by the vibration damping piping part 220 is subjected to decrease of its magnitude corresponding to its absolute value in the Z-axial direction, so that the Z-axial vibration generated from the compressor is reduced.

Therefore, the Z-axial vibration is reduced by the vibration damping piping part 220, as mentioned above. Thereby, it is possible to obtain an effect similar to that the Z-axial piping strength is reinforced as a whole. This is because the Z-axial vibration is divided by the vibration damping piping part 220 as in a component decomposition of the force vector. On the basis of the same principle, the original X-axial vibration component is subjected to decrease of its magnitude corresponding to its absolute value in the X-axial direction by the vibration damping piping part 220, so that the X-axial vibration generated from the compressor is reduced.

According to experimental data, a slant angle of the vibration damping piping part 220 preferably has a range from about 20 to 60 degrees, and a difference between the highest and lowest heights of the vibration damping part preferably is more than 50 mm. This is because the force dispersion according to the vibration is efficiently generated only when the vibration damping piping part must maintain a predetermined range of height and slant angle, so that the Z- and X-axial vibrations generated from the compressor are reduced.

Actually, in the case of the outdoor unit with the vibration damping piping part 220 having the above-mentioned range of slant angle, particularly the Z-axial vibration was about 20.0 $m/s^2$ before improvement, but about 9.1 $m/s^2$ after improvement. Therefore, it can be seen that the Z-axial vibration was improved more than 50%. Further, it can be seen that the X-axial vibration was about 3.4 $n/s^2$ before improvement, but about 3.0 $m/s^2$ after improvement.

Thus, it can be seen that the outdoor unit with the above-mentioned vibration damping piping part 220 in accordance with the invention has considerably reduced the Z-axial vibration.

In the piping structure of the air conditioner according to the invention, the piping part having a predetermined slant angle ranging from about 20 to 60 degrees is provided between the vertical piping part and the looping part, so that the piping part having such a predetermined slant angle functions to reduce the vibration, thus functioning to remarkably reduce the vibration in the whole pipings of the air conditioner.

According to the invention as mentioned above, the piping strength is increased in the up and down direction in the whole pipings, so that the vibration is remarkably reduced in the piping of the air conditioner. Consequently, the vibration of the air condition is suppressed as a whole, so that excessive noises are no longer generated not only to prevent the unpleasant feeling from being given to the user but also to prevent breakdown of components caused by a fatigue resulting from accumulation of the vibration for a long time in advance.

While the invention has been shown and described with reference to certain preferred embodiments thereof, it will be understood by those skilled in the art that various changes in form and details may be made therein without departing from the spirit and scope of the invention as defined by the appended claims.

Figure 5A:
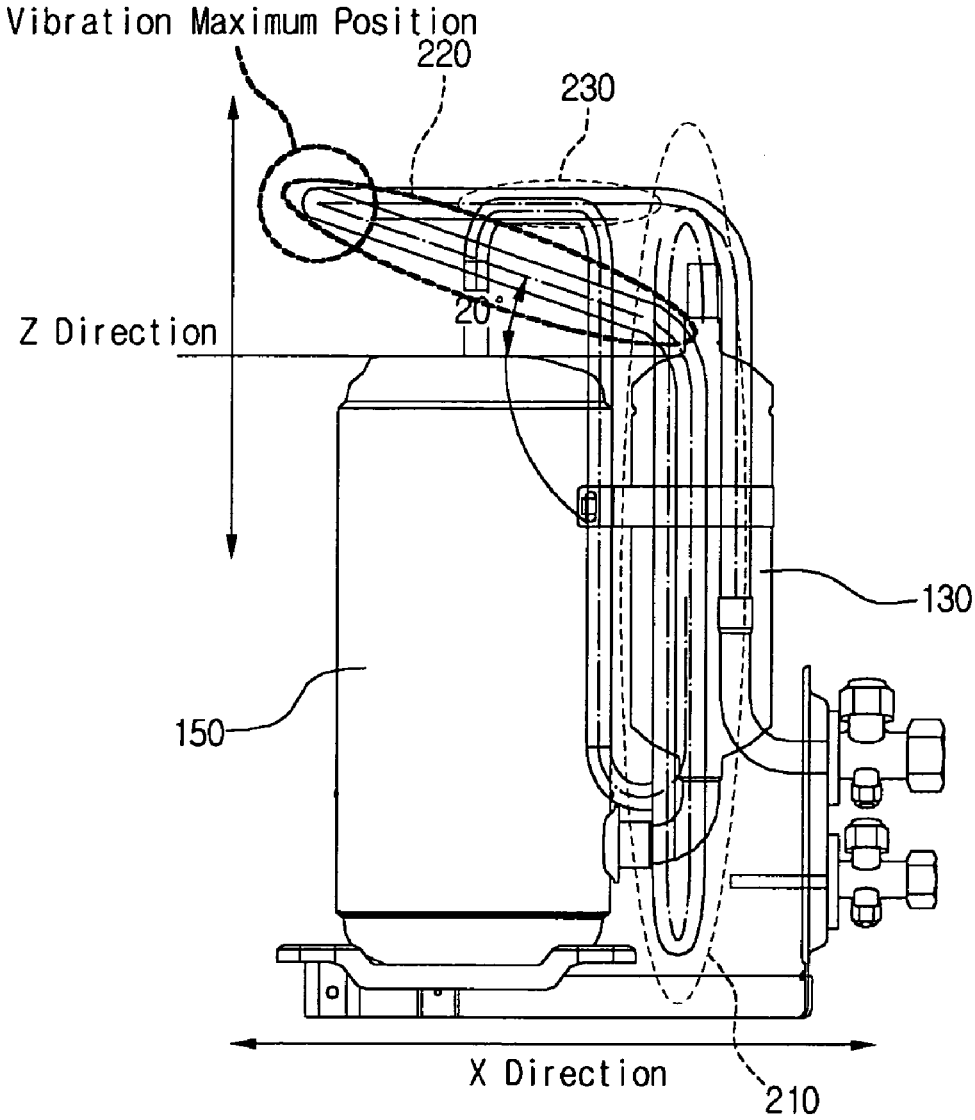
FIGS. 5*a* and 5*b* show a length difference of a piping in case where a slant angle in a piping structure according to the invention is 20 degrees and 60 degrees, respectively.

FIG. 5*a* shows a length difference of the piping in case where the slant angle is 20 degrees in a piping structure according to the invention.

Figure 5B:
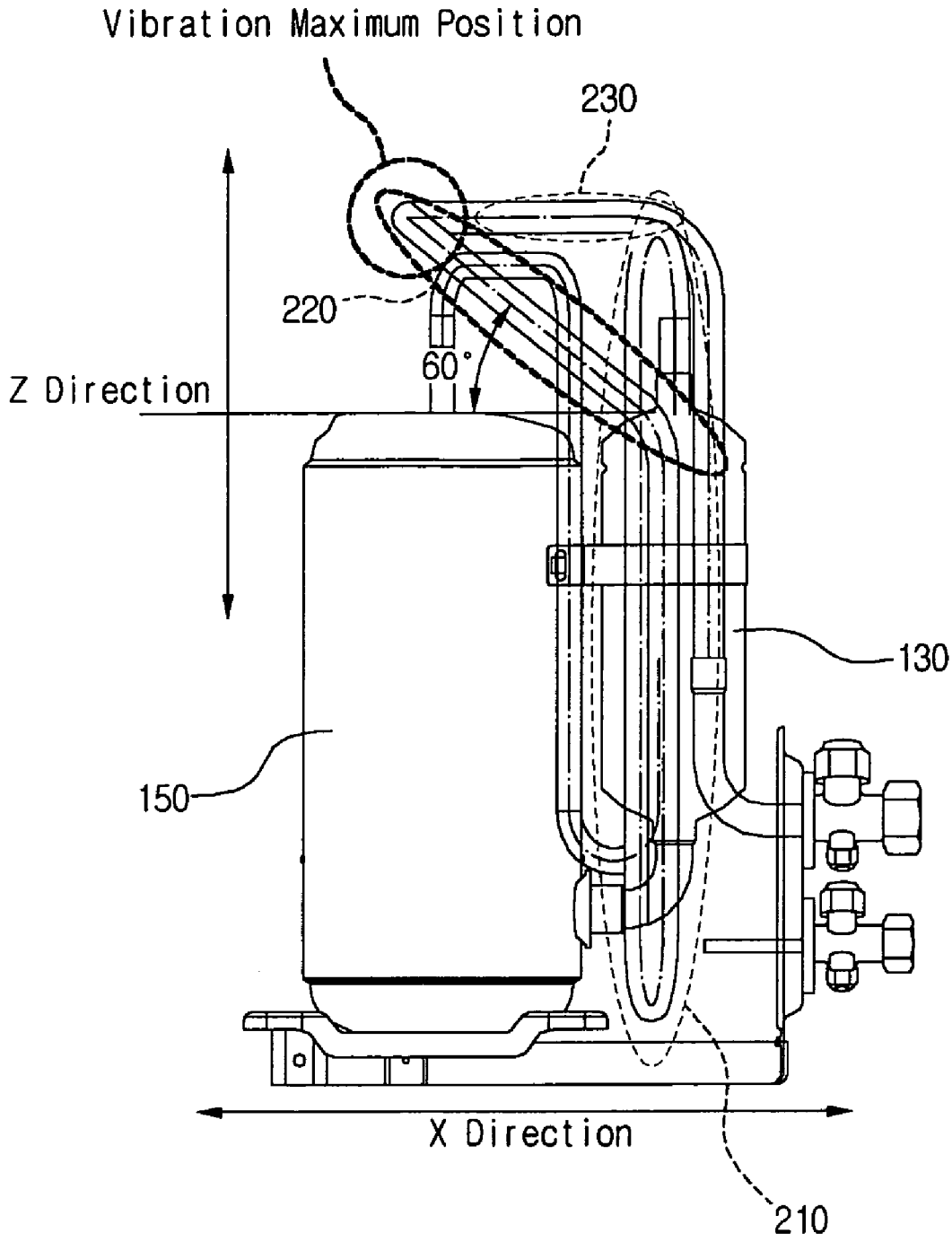

FIG. 5*b* shows a length difference of the piping in case where the slant angle is 60 degrees in a piping structure according to the invention.

Figure 6:
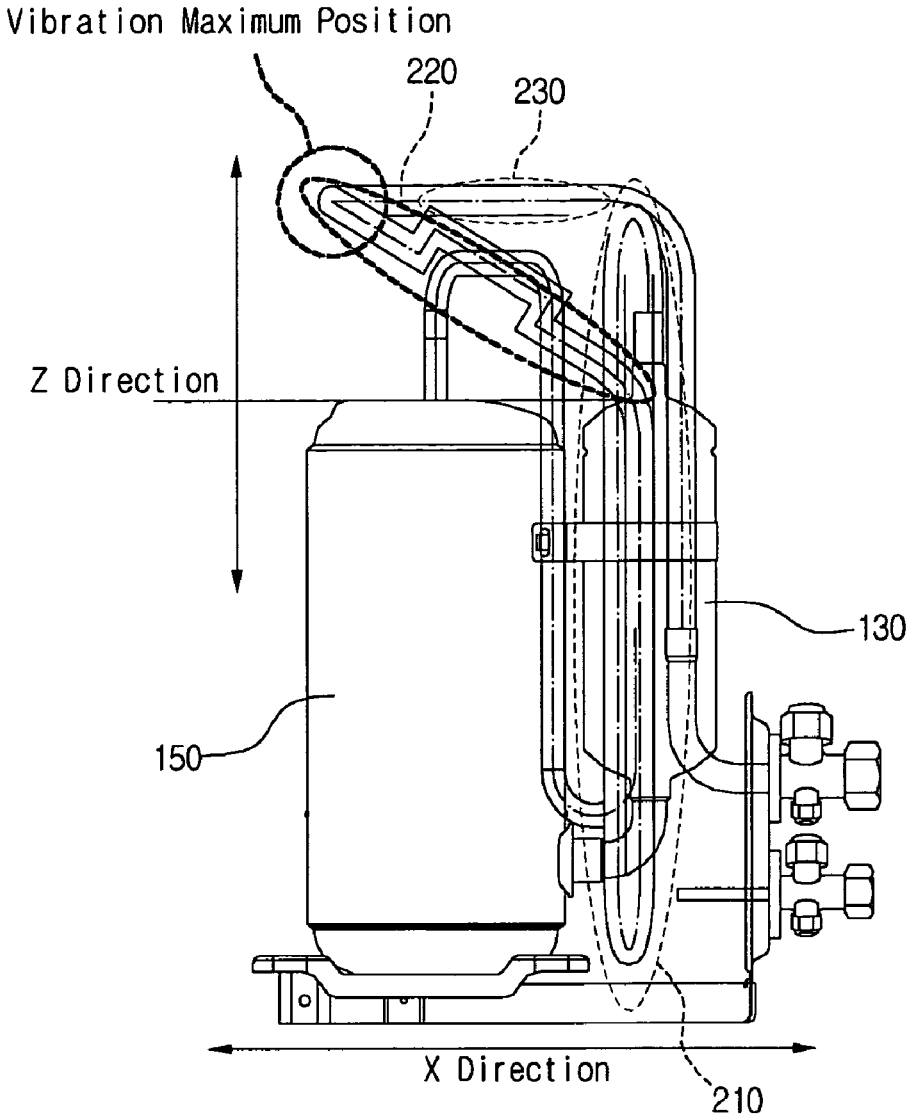
FIG. 6 shows another embodiment of the invention, in which a piping shape is variously configured.

FIG. 6 shows another embodiment of the invention, in which a piping shape is variously configured.

Further, the variation of the piping structure of the invention may be applied to at least one of the intake piping and the discharge piping.

Therefore, the foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A piping structure of an air conditioner having a compressor, in which pipings subject to vibration when the air conditioner compressor is operated are looped, comprising:

a first piping part having a longitudinal axis lying in a first plane;

a second directional piping part having longitudinal axis lying in a plane substantially perpendicular to that of the first plane a third directional piping part having a longitudinal axis and connecting the first and second piping parts and wherein the third directional piping part is slanted at predetermined angle to reduce vibration of the pipings when the air conditioner compressor is operated.

2. The piping structure according to claim 1, further comprising a vibration damping part slantly connected to the vertical piping part as a first directional piping part and to the horizontal piping part as a second directional piping part.

3. The piping structure according to claim 2, wherein the vertical piping part takes a form wound at least one times in an up and down direction, and has a looping part by slantly connecting one end of a vibration damping piping part at an arbitrary position of the vertical piping part and by horizontally connecting the other end of the vibration damping piping part.

4. The piping structure according to claim 2, wherein the vibration damping piping part has a slant angle ranging from about 20 to 60 degrees.

5. The piping structure according to claim 4, wherein the slant angle of the vibration damping piping part causes a vertical vibration to be divided according to a force vector decomposition.

6. The piping structure according to claim 4, wherein the vibration damping piping part has a difference more than 50 mm between its highest and lowest parts.

7. The piping structure according to claim 4, wherein lengths of the vibration damping piping part and the horizontal piping part are variable according to the slant angle of the vibration damping piping part.

8. A piping structure of an air conditioner having a compressor, in which pipings are subject to vibration when the air conditioner compressor is operated, comprising:

a vertical piping part wound in an up and down direction; and a horizontal piping part connected to the vertical piping part having one end oriented at a predetermined slant angle to reduce vibration of the horizontal piping and the vertical piping when the air conditioner compressor is operated.

* * * * *